US010562747B2

(12) United States Patent
Naaber

(10) Patent No.: US 10,562,747 B2
(45) Date of Patent: Feb. 18, 2020

(54) METHOD FOR OPERATING A CLOSING STATION AND CLOSING STATION

(71) Applicant: KHS GmbH, Dortmund (DE)

(72) Inventor: Matthias Naaber, Bretzenheim (DE)

(73) Assignee: KHS GmbH, Dortmund (DE)

( * ) Notice: Subject to any disclaimer, the term of this patent is extended or adjusted under 35 U.S.C. 154(b) by 518 days.

(21) Appl. No.: 15/300,948

(22) PCT Filed: Apr. 21, 2015

(86) PCT No.: PCT/EP2015/058547
§ 371 (c)(1),
(2) Date: Sep. 30, 2016

(87) PCT Pub. No.: WO2015/169580
PCT Pub. Date: Nov. 12, 2015

(65) Prior Publication Data

US 2017/0057799 A1 Mar. 2, 2017

(30) Foreign Application Priority Data

May 5, 2014 (DE) ..... 10 2014 106 205

(51) Int. Cl.

| | |
|---|---|
| ***B67B 3/18*** | (2006.01) |
| ***B67C 7/00*** | (2006.01) |
| ***B67B 1/00*** | (2006.01) |
| ***B67B 3/12*** | (2006.01) |

(52) U.S. Cl.
CPC ..... *B67B 3/18* (2013.01); *B67C 7/00* (2013.01); *B67C 7/0006* (2013.01); *B67B 1/00* (2013.01); *B67B 3/12* (2013.01); *B67B 2201/10* (2013.01); *B67C 2007/0066* (2013.01)

(58) Field of Classification Search
CPC ..... B65B 59/02; B65B 59/04; B67B 1/00; B67B 3/12; B67B 3/18; B67B 3/2013; B67B 3/2033; B67B 2201/10; B67C 7/00; B67C 7/004; B67C 7/0006; B67C 2003/221; B67C 2007/0066
USPC ..... 53/471, 281, 282, 201, 276, 279
See application file for complete search history.

(56) References Cited

U.S. PATENT DOCUMENTS 2,359,932 A * 10/1944 Newey ..... B67B 1/04 53/201
3,660,963 A * 5/1972 Sullivan ..... B67B 3/12 53/488
3,760,561 A * 9/1973 Over ..... B67B 3/12 53/201
5,339,597 A * 8/1994 Naka ..... B65B 59/02 141/144

(Continued)

FOREIGN PATENT DOCUMENTS

DE 26 26 459 12/1977
DE 2626459 A1 * 12/1977 ..... B67B 3/00

(Continued)

*Primary Examiner* — Hemant Desai
*Assistant Examiner* — Veronica Martin
(74) *Attorney, Agent, or Firm* — Occhiuti & Rohlicek LLP

(57) ABSTRACT

A method of operating a closing station includes decoupling a first closing element from a working position of the closing station and moving it away from the working position, bringing a second closing element into the working position, and coupling it into the container transport path at the working position.

20 Claims, 5 Drawing Sheets

(56) References Cited

U.S. PATENT DOCUMENTS

| | | | | | |
|---|---|---|---|---|---|
| 5,402,623 | A * | 4/1995 | Ahlers | ..... | B67B 3/02 53/268 |
| 7,204,066 | B2 * | 4/2007 | Monti | ..... | B67B 3/2033 53/287 |
| 2017/0057799 | A1 * | 3/2017 | Naaber | ..... | B67C 7/00 |

FOREIGN PATENT DOCUMENTS

| | | | | | |
|---|---|---|---|---|---|
| DE | 102012000881 | A1 * | 6/2013 | ..... | B67B 3/00 |
| EP | 0 572 107 | | 12/1993 | | |
| EP | 1 939 095 | | 7/2008 | | |
| EP | 2 199 220 | | 6/2010 | | |
| EP | 2199220 | A2 * | 6/2010 | ..... | B65C 9/0062 |
| WO | WO-2010149233 | A1 * | 12/2010 | ..... | B65D 51/228 |
| WO | WO-2018166690 | A1 * | 9/2018 | ..... | B67B 3/28 |

* cited by examiner

METHOD FOR OPERATING A CLOSING STATION AND CLOSING STATION

RELATED APPLICATIONS

This is the national stage under 35 USC 371 of PCT/EP2015/058547, filed Apr. 21, 2015, which claims the benefit of the May 5, 2014 priority date of German application DE 102014106205.1, the contents of which are herein incorporated by reference.

FIELD OF INVENTION

The invention relates to container processing, and in particular, to closing containers.

BACKGROUND

According to the current state of the art, filling plants for the filling and closing of containers with different types of container seals require different closing elements, i.e. closing machines, that are adapted to the type and processing of the respective container seals. Known kinds or types of container seals are corks, including natural corks, screw caps, including rolled-on screw caps, crown caps, clip tops, etc.

Different container types often require different container seals. To accommodate this, it is known to provide different closing elements. It is customary for these closing elements to be permanently provided in the filling plant in a container transport direction along which the containers are conveyed through the filling plant, disposed at a container outlet of the filling machine, and arranged in cascade-like succession. As a result, a filled container has to pass through all closing elements, even those that cannot close it.

SUMMARY

A disadvantage of known filling plants that are configured for processing different container types and hence necessarily for handling different types of container seal is that the containers, while still open, are transported over relatively long distances before finally being closed. This means, among other things, that under adverse conditions, dirt and/or bacteria harmful to the product can enter the open containers. This is extremely undesirable. In addition, the long distances over which the containers are conveyed subject the containers themselves to increased wear.

Another disadvantage arises when closing elements are provided in cascade-like succession in the transport path of the containers. Under these circumstances, all the closing elements, or their transport elements or rotors, are constantly running while the filling plant is running. This means greater wear and tear and energy consumption for the closing elements.

If transfer screws are used to divert the containers to whichever closing element is appropriate. This means that numerous container guide components have to be changed over when there is a switch from one closing element to another closing element. This change-over requires both time and effort.

The apparatus and methods described herein provide a remedy and an improvement to this situation, i.e. while avoiding the afore-mentioned disadvantages to provide a method for operating a closing station or filling plant and to configure a closing station so as to facilitate a trouble-free changeover from one type of container seal to another type of container seal.

It is a particular attribute of the that, along the container transport path, a closing-element position is provided downstream of the filling machine or of its container outlet in the container transport direction, and that a closing element that is suitable for the processing of container seals of the current type of container seal is provided at the said closing-element position. During the changeover to another type of container seal, a change of closing element takes place at the preferably single closing-element position of the filling plant, i.e. the closing element of one type that is currently in use until the changeover is uncoupled from the closing-element position and switched for a closing element of another type which was located in a parked or idle position before the changeover and is suitable for processing container seals of the other container seal type.

Among the advantages of the apparatus and methods described herein is that each filled container always travels to the closing element by the shortest route, i.e. each container is closed as soon as it leaves the filling machine. This avoids a long opportunity for contamination.

Another advantage is that the filling machine's container outlet, e.g. a suitable transport star, can still be used as the container inlet of the closing element that is currently in use. This reduces the number of transport elements, for example the number of transport stars etc., between the filling machine and the closing element. It also reduces the number of format parts that have to be changed over and adapted to different container types.

Another advantage is that, especially when appropriate preparations are made in a filling plant, it is also possible to retrofit this plant with a second or further closing elements without having to interfere with the plant layout.

Yet another advantage is that servicing and/or maintenance work can be carried out on a closing element that is located in the parked or idle position while the filling plant is in operation.

The filling machine is preferably a rotary-type filling machine having a rotor which can be driven to rotate about a vertical machine axis and around whose periphery are provided a plurality of filling positions for holding and filling one container each.

The closing elements are preferably also of a rotary type and comprise, for example, the layout, known to the skilled person, of for example a closing machine, i.e. each closing element comprises, as a preferably fully functional unit, including a rotor that is driven to rotate about a vertical machine axis and around whose periphery closing-element positions with container holders and closing tools are distributed at equal angular distances about a vertical closing element axis VA. The container holders and closing tools are adapted to the type of the container seal, for example for closing the containers with corks, including natural corks, screw caps, including rolled-on screw caps, crown caps, clip tops etc.

The closing elements that can be switched for a change of container seal can also be configured such that, as closer units each mounted on a transport element such as a rotor or rotor element, they comprise only the closing tools, while a base unit for a plurality of, or for all, closing elements together, and which comprises the container holders on a further transport element, e.g. on a further rotor or rotor element, is permanently disposed at the closing-element position so that, for the container seal changeover, only the closing elements configured as closer units are switched over and connected for driving purposes with the base unit and the other components of the filling plant.

As used herein, "containers" refers to bottles and cans produced preferably from metal, glass and/or plastic.

As used herein, "essentially," "in essence," or "around" mean variations from the respective exact value by ±10%, preferably by ±5% and/or variations in the form of changes insignificant for the function.

As used herein, the " closing-element position," or "working position," is the position in the container transport path where whichever closing element is currently being used is located.

Further embodiments, advantages, and possible applications of the apparatus and methods described herein arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

BRIEF DESCRIPTION OF THE DRAWINGS

These and other features of the invention will be apparent from the following detailed description and the accompanying figures, in which.

DETAILED DESCRIPTION

Figure 1:
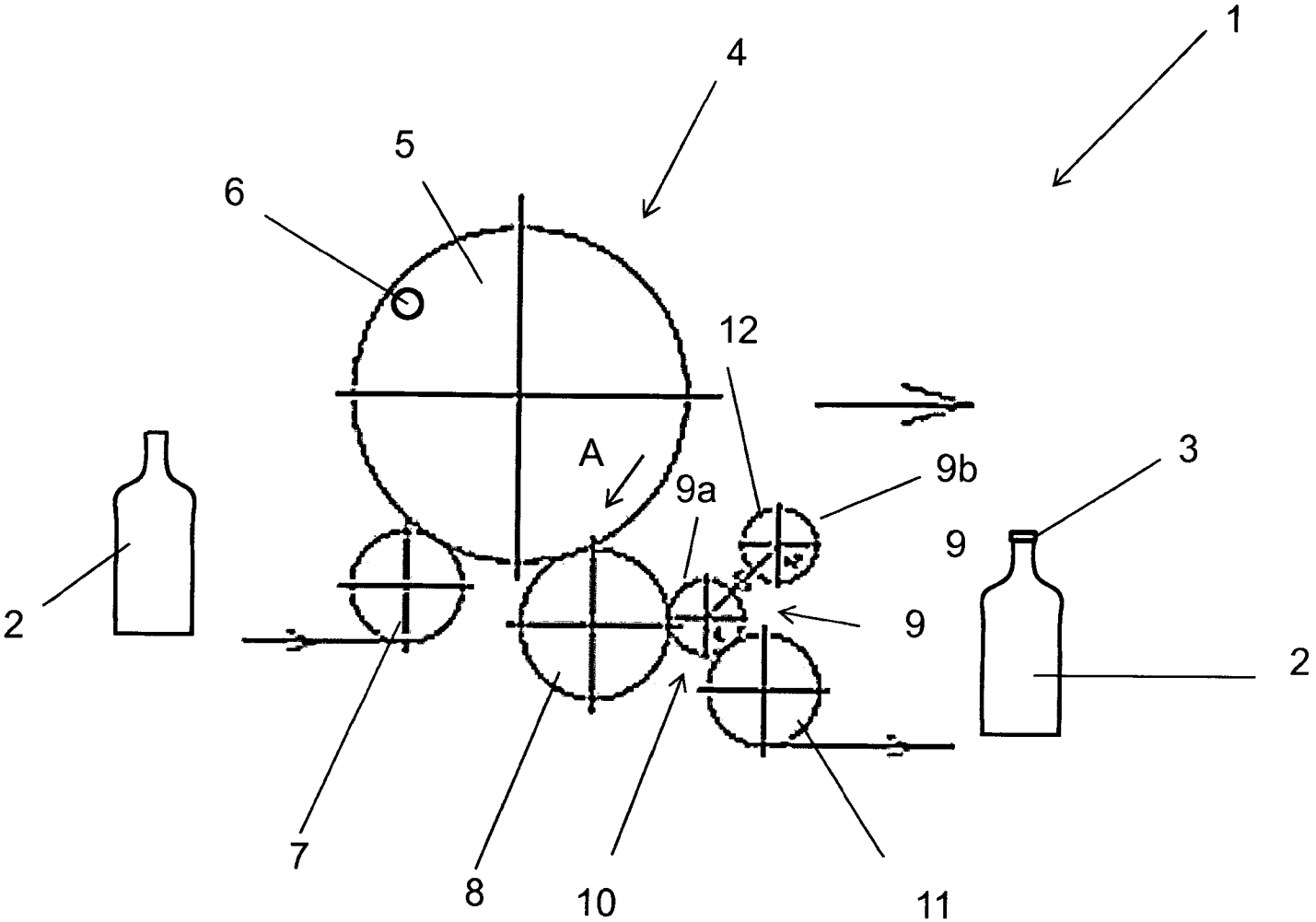
FIG. 1 shows a schematic plan view of a filling plant for filling containers with a product and for subsequently closing the filled containers.

FIG. 1 shows a filling plant 1 used for the filling containers 2, usually with a liquid product, for example a drink, and for subsequently closing the openings of the resulting filled containers 2 with a container seal 3. In the particular embodiment shown herein, the containers 2 happen to be bottles. However, other kinds of containers can also be used.

The filling plant 1 includes a rotary filling-machine 4 having a rotor 5 with filling positions 6 distributed at equal angular intervals around a periphery thereof. The rotor 5 rotates about a vertical machine axis MA in a rotation direction A.

An external transporter conveys containers 2 that are to be filled to these filling positions 6 through a container inlet that comprises a first transport star 7. The filled containers 2 are conveyed across a second transport star 8 to a closing station 9 that closes containers 2 with container seals 3.

The closing station 9 has first and second closing elements 9*a*, 9*b*. When the filling plant 1 is in its operating state, as depicted in FIG. 1, the second closing element 9*b* is in a parked or idle position outside the container transport path, and the first closing element 9*a* is inside the container transport path in a closing-element position 10.

In the configuration shown, the first closing element 9*a* is the working closing element, and the second closing element 9*b* is the idle closing element. The first and second closing elements 9*a*, 9*b* are able to swap positions so that the second closing element 9*b* becomes the working closing element and the first closing element 9*a* becomes the idle closing element.

Closed containers 3 from the first closing element 9*a* are conveyed onward to an external transporter through a container outlet of the closing station 9. This container outlet comprises a third transport star 11. The second transport star 8 also forms the container inlet of the closing station 9. The sole closing-element position 10 of the filling plant 1 is thus located between the second transport star 8 and the third transport star 11.

The first closing element 9*a* seals filled containers 2 with a first type of container seal 3. Meanwhile, the second closing element 9*b* seals filled containers 2 with a second type of container seal 3. Therefore, by swapping the first and second closing element 9*a*, 9*b* as described above, it is possible to reconfigure the apparatus to seal containers 2 with different types of container seals 3. Moreover, only the closing element 9*a*, 9*b* that is currently in use will actually be present along the container transport path between the filling machine's container outlet, at the second transport star 8, and the filling plant's container outlet, at the third transport star 11.

In some embodiments, the closing element 9*a*, 9*b* has a closing tool that cooperates with a base unit. The base unit includes the container holders on a rotor. This unit can be permanently disposed at the closing-element position 10. This means that when the first closing element 9*a* is swapped into position at the closing-element position 10, its closing tool will cooperate with the base unit, while when the second closing element 9*b* is swapped into position, its closing tool can cooperate with the same base unit.

The filling machine 4, the rotor 5, the first, second, and third transport stars 7, 8, 11, as well whichever closing element 9*a*, 9*b* has been swapped into the closing-element position 10, and in particular a rotor 12 of that closing element 9*a*, 9*b*, are driven synchronously, and in particular pitch-synchronously, by appropriate drives. This guarantees smooth passage of the containers 2 from the container inlet to the filling positions 6, via the second transport star 8, to the closing element 9*a*, 9*b* at the closing-element position 10 and from the closing element 9*a*, 9*b* to the container outlet or to the third transport star 11 located at the container outlet.

Figure 2:
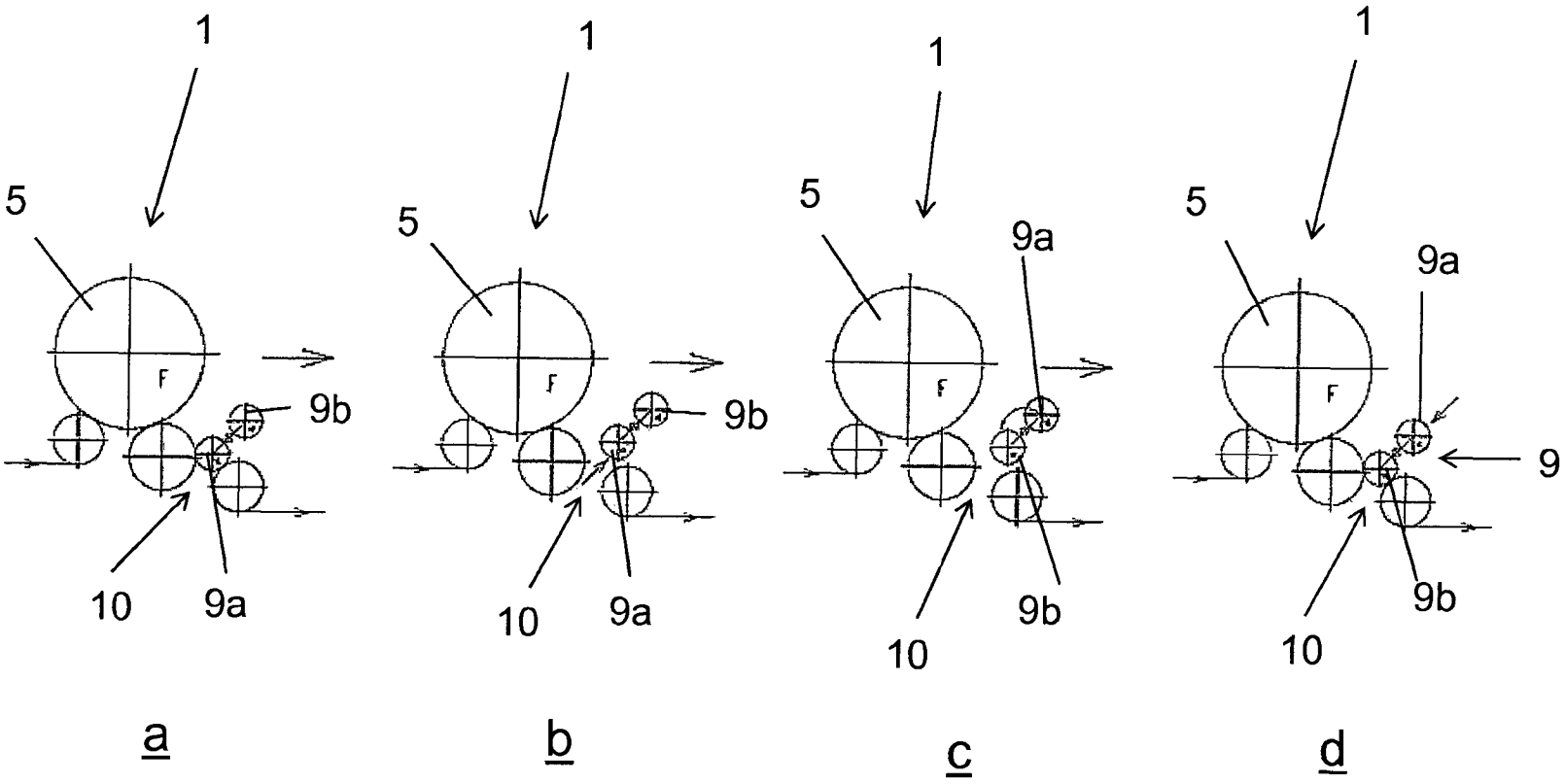
FIG. 2 shows four states for the filling plant shown in FIG. 1.

FIG. 2 shows the filling plant 1 in first through fourth operating states a-d as it changes over from sealing with a first type of seal 3 and sealing with a second type of seal 3.

The filling plant 1 shown in FIG. 1 is configured to seal with a first seal type using the first closing element 9*a*. In FIG. 2, this corresponds to the first operating state a.

Conversion of the filling plant 1 so that it seals with the second seal type begins with uncoupling the closing element 9*a* from the closing-element position 10 and initially moving it to the side into a neutral position. This is preferably carried out by a horizontal or essentially horizontal sideways motion. In this neutral position, the first closing element 9*a* is sufficiently far from the closing-element position 10 and the second and third transport stars 8, 11 to avoid interfering with their operation.

In the illustrated embodiment, the movement involves moving the entire closing element array, including the first and second closing elements 9*a*, 9*b*, to the interim or changeover position to achieve a second operating state b.

The next step is to swap the first and second closing elements 9*a*, 9*b* so that the second closing element 9*b* now assumes the position previously occupied by the first closing element 9*a*. This brings about a third operating state c.

The second closing element 9*b* is now moved into the closing-element position 10 and coupled to this position or to the filling plant 1 to bring about the fourth operating state d. This coupling is such as to guarantee synchronous, and in particular pitch-synchronous, operation of the second closing element 9*b* with the other components of the filling plant 1. This guarantees closure of the filled containers 2 with seals 3 of the second type. Meanwhile, the first closing element 9*a* now occupies the parked or idle position previously occupied by the second closing element 9*b* before the first and second closing elements 9*a*, 9*b* were swapped.

Figure 3:
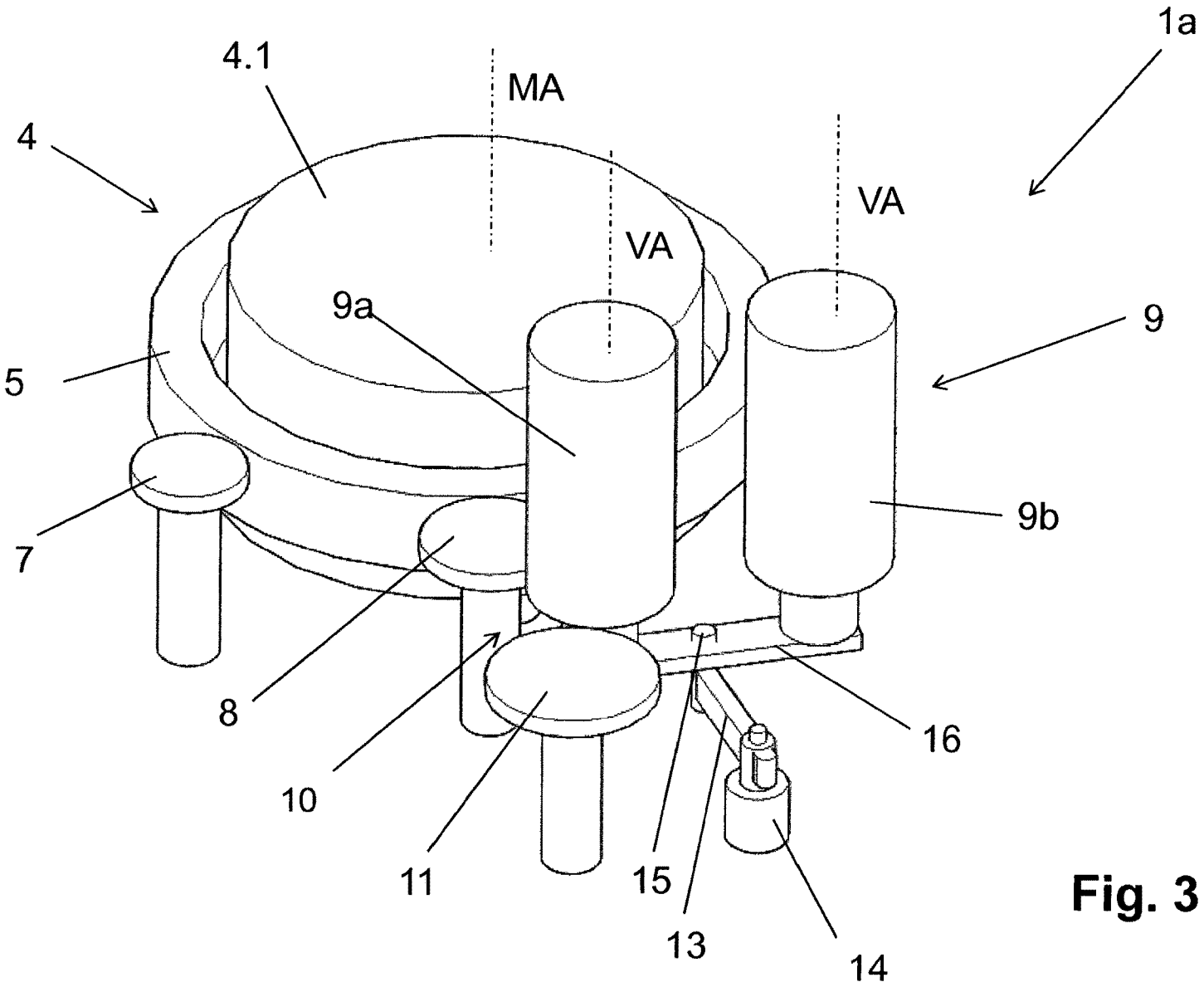
FIGS. 3 and 4 show an alternative embodiment of a filling plant.
Figure 4:
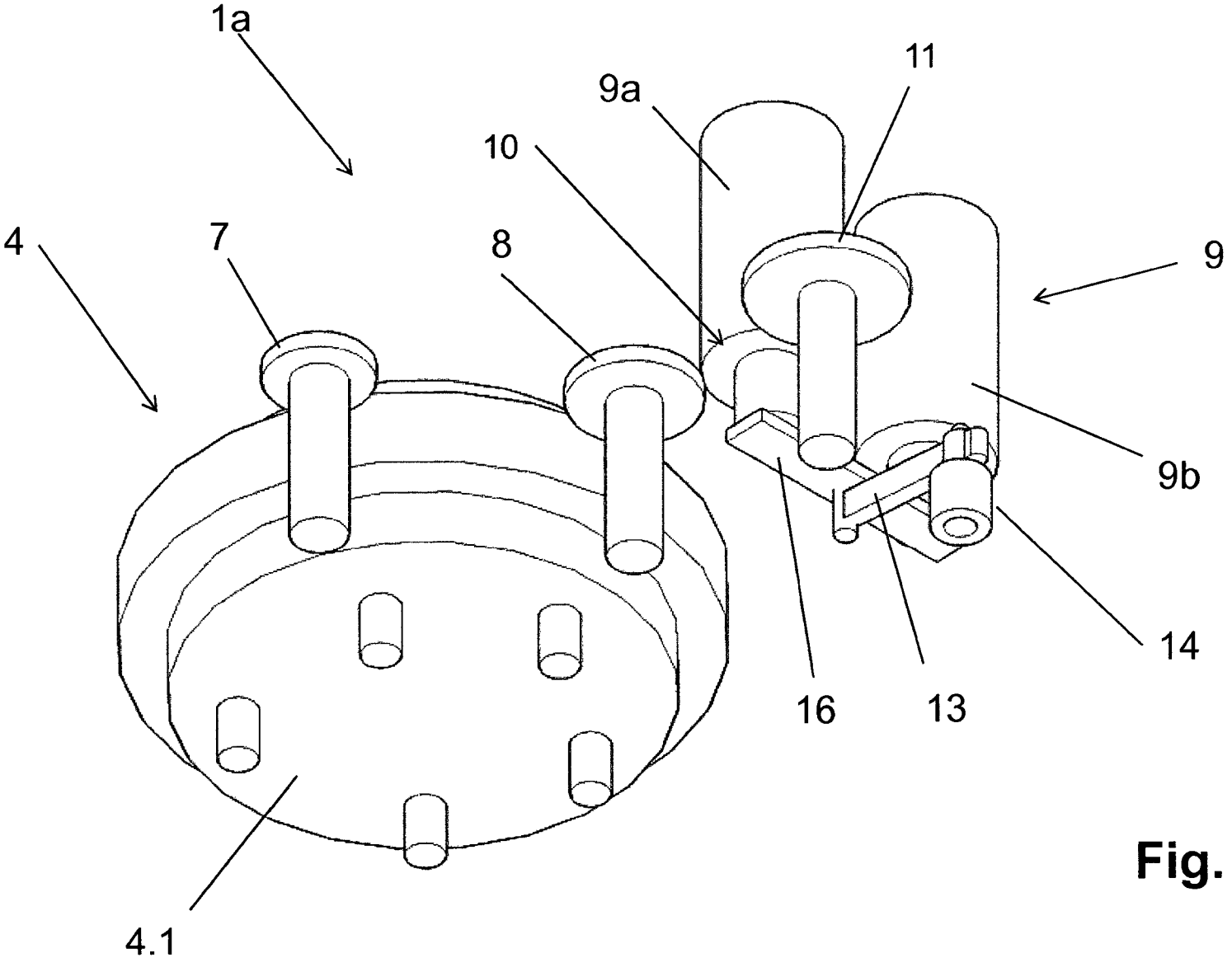

FIGS. 3 and 4 show an alternative filling plant 1*a* similar to that shown in FIG. 1. The alternative filling plant la includes a filling machine 4 having an annular rotor 5 rotatably mounted on a stationary part 4.1 that does not rotate with the rotor 5.

The filling machine 1*a* includes a support arm 13 having a first end and a second end. A joint 15 provides a swiveling connection between a carrier 16 and the support arm's first end. This carrier 16 carries the closing element array. In the illustrated embodiments, the closing element array's first and second closing elements 9*a*, 9*b* are at opposite ends of the carrier 16 and equidistant from the joint 15.

A bearing 14 holds the support arm 13 at its second end. As a result, the support arm 13 is able to swivel about an axis parallel to the machine axis MA and a closing element axis VA. This permits the support arm 13 to swivel so as to move the first and second closing elements 9*a*, 9*b* to an interim or changeover position. While at the interim position, swiveling the carrier 16 about the joint 15 swaps the positions of the first and second closing elements 9*a*, 9*b*.

Figure 5:
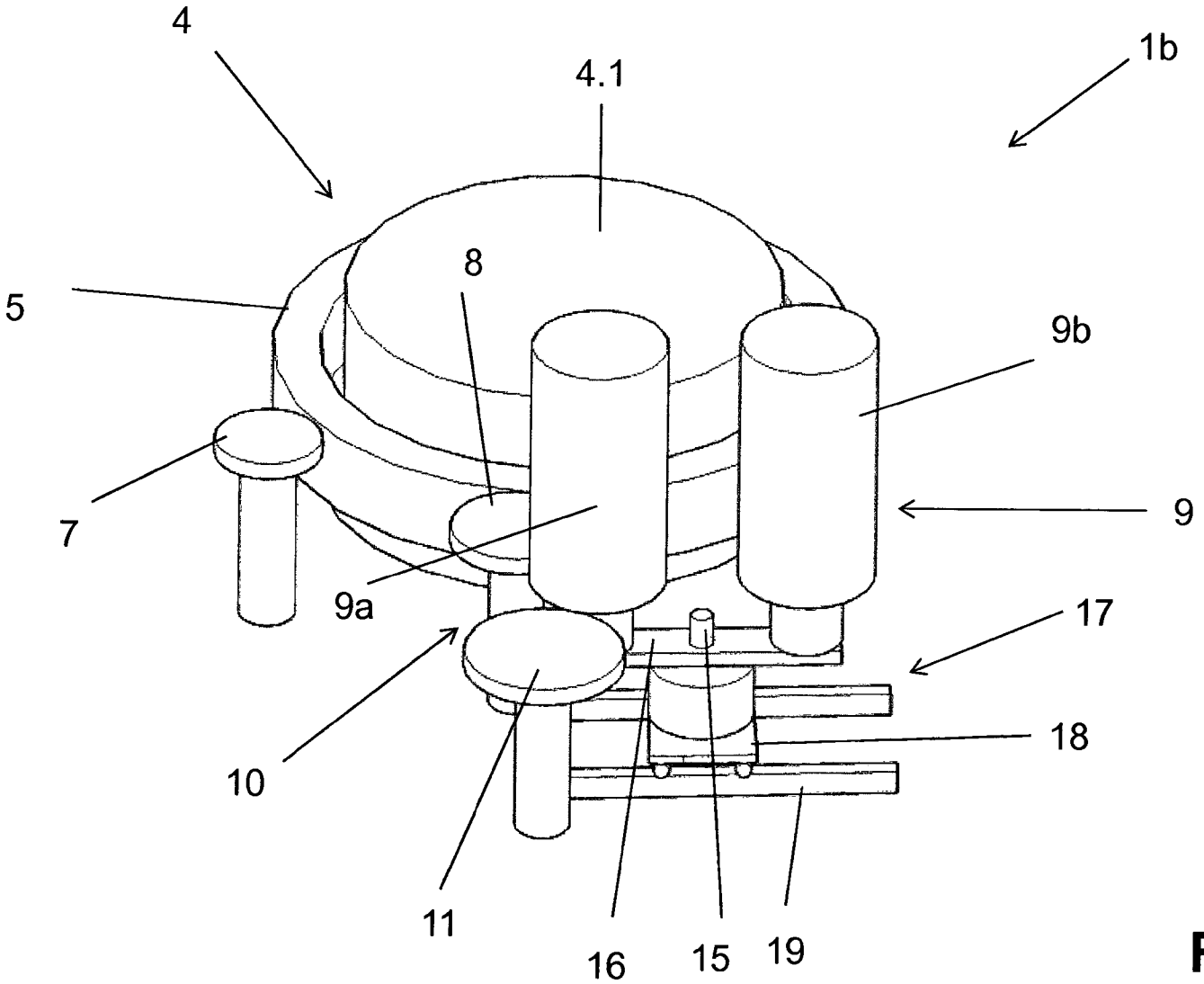
FIG. 5 shows an embodiment similar to that shown in FIG. 3.

FIG. 5 shows a second alternative filling plant 1*b* similar to that shown in FIG. 4. In this filling plant 1*b*, the joint 15 connects the carrier 16 to a slide and rail system 17 and in particular, to a carriage 18 that is part of that rail system 17. The carriage 18 carries the carrier 16 along a rail 19 to an interim position where the positions of the first and second closing elements 9*a*, 9*b* can be swapped as described in connection with FIGS. 3 and 4.

The embodiments described thus far have only two closing elements 9*a*, 9*b* in the closing station 9. However, there can be more than two closing elements, each of which closes containers with a different type of seal.

It has also been assumed that before they can be swapped, the first and second closing elements 9*a*, 9*b* must first be moved to a neutral interim or changeover position in which the position of the first and second closing elements 9*a*, 9*b* can be changed by using the swiveling joint 15 to rotate a carrier 16 about its vertical axis. While this configuration does indeed allow swapping the first and second closing elements 9*a*, 9*b* within a compact space, configurations are also possible in which, when swapping the closing elements 9*a*, 9*b*, only the closing element 9*a*, 9*b* that is to be switched and uncoupled from the closing-element position 10 is moved to an interim position and the new closing element is then moved to the closing-element position 10. In such a case, it is preferable for the exchanged closing element to be moved into the idle position previously occupied by the closing element that has now been moved to closing-element position 10.

It is preferable that at least the filling machine 4 and the first and second closing elements 9*a*, 9*b* not be mechanically coupled for driving but that they each comprise their own drive. Suitable drives are servo motors that are electronically controlled in such a way as to engage in synchronous, and in particular, in pitch-synchronous operation of the components of the filling plant 1, 1*a* and 1*b*. This can be achieved by electrical or electronic coupling between a drive of the filling machine 4 and a drive of whichever one of the first and second closing elements 9*a*, 9*b* happens to be located at the closing-element position 10. Such synchronous operation can also be achieved by controlling these drives with a central plant controller. The necessary synchronization between whichever closing element 9*a*, 9*b* has just been moved into the closing-element position 10 and the plant as a whole can be effected purely electronically in this simple way.

In any event, upon a changeover from one type of container seal to another type of container seal, whichever closing element 9*a*, 9*b* is currently located at the closing-element position 10 uncouples out of that closing-element position 10 position and moves out of the transport path of the containers 2 into the interim or changeover position. Meanwhile, a new closing element 9*b*, 9*a* moves out of the rest position and into the closing-element position 10 so that the replaced closing element can now occupy the rest position previously occupied by closing element 9*b*, 9*a* that replaced it. The closing element 9*a* that is to be replaced and the closing element 9*b* that replaces it preferably switch their positions while still in the interim or changeover position, as has been described above.

As described thus far, closing elements are only switched only for the purpose of providing a closing element that can close with a different type of seal. However, the purpose of carrying out the swapping procedure is not important. For example, there is no requirement that the closing elements all close with different types of seals. For example, the swapping procedure outlined herein is potentially useful if closing elements have to be changed over at short notice for servicing, preventive maintenance, or in case a closing element breaks down.

Although the invention has been described in connection with rotary filling machines, nothing prevents the invention from being used along a transport path of a linear-type container treatment machine. After all, a linear path is merely the limit of a circular path as radius goes to infinity.

Having described the invention, and a preferred embodiment thereof, what is claimed as new, and secured by Letters Patent is:

1. A method comprising operating a closing station that is provided in a filling plant for filling containers with a filling product, wherein said closing station comprises first and second closing elements located at a closing element position for closing containers and arranged in a container transport path downstream of a filling machine in a container transport direction, a carrier, a carriage, a joint, and a rail, wherein said carriage travels along said rail, wherein said joint joins said carrier to said carriage, wherein said carrier supports said closing elements, and wherein said carrier rotates about said joint relative to said carriage, wherein operating said closing station comprises electrically or electronically synchronizing one or more servo drives that drive said first and second closing elements with a servo motor that drives said filling machine, uncoupling said first closing element from a working position of said closing station by causing horizontal sideways motion of said first closing element, moving said first closing element away from said working position, bringing said second closing element into said working position, said working position having been vacated by said first closing element, and coupling said second closing element into said container transport path at said working position by laterally moving said second closing element.

2. The method of claim 1, further comprising, prior to having decoupled said first closing element, using said first closing element to close a first container with a first type of container seal, and, after having coupled said second closing element, using said second closing element to close a second container with said first type of seal.

3. The method of claim 1, further comprising driving said first and second closing elements with a common drive.

4. The method of claim 1, wherein decoupling comprises decoupling said first closing element from a base that is permanently located at said working position, wherein coupling comprises coupling said second closing element with said base, and wherein said base is shared by said first and second closing elements.

5. The method of claim 1, further comprising driving said first and second closing elements with corresponding first and second drives.

6. The method of claim 1, wherein moving said first closing element away from said working position comprises moving said first closing element toward a changeover position, said method further comprising, concurrently with moving said first closing element, moving said second closing element toward said changeover position.

7. The method of claim 6, further comprising, after having moved said first and second closing elements, causing said first and second closing elements to change places at an interim position of said closing station, wherein said closing elements move together between said working position and said interim position.

8. The method of claim 6, further comprising, after having moved said first closing element away from said working position and before bringing said second closing element into said working position, swiveling said first and closing elements about a vertical axis at an interim position of said closing station, wherein said closing elements move together between said working position and said interim position.

9. An apparatus comprising a closing station to close containers with seals after said containers have been filled by a filling machine, said closing station comprising a carrier, a carriage, a joint, a rail, and first and second closing elements, each of which is movable between a working position and a rest position, wherein said carriage travels along said rail, wherein said joint joins said carrier to said carriage, wherein said carrier supports said closing elements, and wherein said carrier rotates about said joint relative to said carriage, and wherein said first and second closing elements are driven by one or more servo motors synchronized with a servo motor that drives said filling machine, wherein uncoupling said first closing element from said working position comprises causing horizontal sideways motion thereof, and wherein coupling said second closing element into said working position comprises laterally moving said second closing element.

10. The apparatus of claim 9, wherein said first closing element is configured to close containers with a first type of seal, wherein said second closing element is configured to close containers with a second type of seal that differs from said first type, wherein, when said first closing element is in said working position, said closing station closes containers with said first type of seal, and wherein, when said second closing element is in said working position, said closing station closes containers with said second type of seal.

11. The apparatus of claim 9, wherein said closing station further comprises an interim position, wherein said first and second closing elements are configured to move together between said working position and said interim position, wherein said first and second closing elements are configured to move between said interim position and said rest position, and wherein, at said interim position, said first and second closing elements swap positions.

12. The apparatus of claim 9, wherein said first closing element is configured to engage in sideways movement during decoupling from said working position and coupling to said rest position, and wherein said second closing element is configured to engage in lateral movement during decoupling from said rest position and during coupling to said working position.

13. The apparatus of claim 9, further comprising an interim position between said rest position and said working position, wherein said first closing element is configured to move from said working position to said interim position concurrently with said second closing element moving from said rest position to said interim position, wherein said first and second closing elements are configured to exchange places while at said interim position, and wherein, after having exchanged places, said first closing element is configured to continue on to said rest position while said second closing element is configured to continue on to said working position.

14. The apparatus of claim 9, further comprising an interim position, wherein said first and second closing elements are configured to move together toward said interim position, to exchange places while at said interim position, and to be moved away from said interim position after having exchanged places wherein said-closing station comprises a carrier on which said first and second closing elements are mounted, and wherein said carrier is configured to be moved to said interim position and to be swiveled about an axis thereof while said carrier is in said interim position.

15. The apparatus of claim 9, further comprising a common drive, wherein said first and second closing elements share said common drive.

16. The apparatus of claim 9, further comprising a base unit at said working position, wherein said first closing element comprises a closing unit, said closing unit comprising a rotor, a container carrier and closing tools on said rotor, wherein, when said first closing element is at said working position, said closing unit cooperates with said base unit, and wherein said base unit cooperates with whichever closing element is at said working position.

17. The apparatus of claim 9, further comprising a filling plant, wherein said filling plant comprises said filling machine, wherein said closing station is arranged downstream of said filling machine along a container-transport direction, and wherein said filling machine comprises an annular rotor rotatably mounted on a stationary part that does not rotate with said annular rotor.

18. The apparatus of claim 9, wherein each of said closing elements has its own drive.

19. The apparatus of claim 9, wherein, as a result of said filling machine and said closing elements each comprising their own respective drives, there exists an absence of mechanical coupling for driving between said closing station and said filling machine.

20. The apparatus of claim 9, wherein said closing station further comprises a carrier, a joint, a support arm, and a bearing, wherein said carrier supports said closing elements, wherein said support arm rotates about said bearing, wherein said carrier rotates about said joint, and wherein said joint joins said support arm to said carrier.

* * * * *